US006584043B1

(12) United States Patent
Koike et al.

(10) Patent No.: US 6,584,043 B1
(45) Date of Patent: Jun. 24, 2003

(54) ELECTRONICALLY CONTROLLED MECHANICAL WATCH AND METHOD OF PREVENTING OVERCHARGE

(75) Inventors: Kunio Koike, Matsumoto (JP); Eisaku Shimizu, Okaya (JP); Hidenori Nakamura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/600,527

(22) PCT Filed: Oct. 27, 1999

(86) PCT No.: PCT/JP99/05955

§ 371 (c)(1),
(2), (4) Date: Jul. 17, 2000

(87) PCT Pub. No.: WO00/29913

PCT Pub. Date: May 25, 2000

(30) Foreign Application Priority Data

Nov. 17, 1998 (JP) ..... 10-326820

(51) Int. Cl.[7] ..... G04B 1/00; G04C 3/00
(52) U.S. Cl. ..... 368/204
(58) Field of Search ..... 368/204, 155, 368/64, 66, 140, 156, 157

(56) References Cited

U.S. PATENT DOCUMENTS 5,001,685 A * 3/1991 Hayakawa ..... 368/204
5,581,519 A * 12/1996 Hara et al. ..... 368/204
5,740,131 A * 4/1998 Bernasconi ..... 368/204
6,041,021 A * 3/2000 Shinkawa et al. ..... 368/204
6,046,514 A * 4/2000 Rouillard et al. ..... 320/122
6,052,337 A * 4/2000 Yuzuki et al. ..... 368/157

FOREIGN PATENT DOCUMENTS

| | | | |
|---|---|---|---|
| EP | 0862 099 | 9/1998 | |
| JP | 55-87979 | 7/1980 | |
| JP | 361030791 A * | 2/1986 | ..... 368/204 |
| JP | 61-236332 | 10/1986 | |
| JP | 8-75874 | 3/1996 | |
| JP | 9-171086 | 6/1997 | |
| JP | 10-62571 | 3/1998 | |
| JP | 10-78488 | 3/1998 | |
| JP | 10-111370 | 4/1998 | |
| JP | 02000201483 A * | 7/2000 | ..... 368/204 |
| JP | 02000346963 A * | 12/2000 | ..... 368/204 |

* cited by examiner

*Primary Examiner*—Vit Miska
*Assistant Examiner*—Jeanne-Marguerite Goodwin
(74) *Attorney, Agent, or Firm*—Mark P. Watson

(57) ABSTRACT

With respect to a generator (20), a storage device (22) for storing electrical energy output from the generator and a bypass circuit (31) are connected in parallel with each other. A bypass circuit switch (33) of this bypass circuit (31) is controlled on and off according to the voltage of the storage device (22). This makes it possible to reduce the input current into the storage device so as to implement a reduction in the voltage of the storage device, thereby preventing overcharging. Moreover, since a generated waveform corresponding to the rotation period of the generator can be obtained, the rotation period of the generator can be controlled highly precisely and reliably based on this generated waveform, thereby implementing the indication of the correct time.

19 Claims, 7 Drawing Sheets

ELECTRONICALLY CONTROLLED MECHANICAL WATCH AND METHOD OF PREVENTING OVERCHARGE

BACKGROUND OF THE INVENTION

1. Technical Field

The present invention relates to an electronically controlled mechanical timepiece and an overcharge-prevention method therefor. More particularly, the invention relates to an electronically controlled mechanical timepiece having a mechanical energy source, a generator for outputting electrical energy and being driven by this mechanical energy source and by generating induction power, a storage device for storing the electrical energy output from the generator, and a rotation control device for controlling the rotation period of the generator and being driven by the electrical energy supplied from the storage device. The invention also pertains to an overcharge-prevention method for the electronically controlled mechanical timepiece.

2. Background Art

In general, regular replacement of batteries is required for timepieces. These days, however, easy-to-handle and environmentally friendly timepieces are known in which the replacement of batteries is eliminated by charging power generated by a generator, such as an oscillating weight, a mainspring, a solar cell, etc., in a storage device, such as a capacitor or a secondary cell, and by using the charged power as a driving source.

Among such generators for use in timepieces, unlike a solar cell, a generator for generating power by rotating a rotor by a mainspring is not subject to constraints, such as environment, place, time, and so on, and can stably and reliably generate power by a user winding the mainspring. Accordingly, the above type of generator is widely used.

Electronic apparatuses using a mainspring generator include, for example, an electronically controlled mechanical timepiece. In the electronically controlled mechanical timepiece, mechanical energy generated when a mainspring is unwound is converted into electrical energy by a generator. A rotation control device is operated by this electrical energy so as to control the current value flowing in a coil of the generator, thereby correctly driving the hands fixed to a wheel train. As a result, the time can be correctly displayed. According to this type of timepiece, by detecting the generated waveform of the generator, the rotational speed of the rotor is determined, and braking control is performed so that the rotational speed (phase) of the rotor is matched to the speed (phase) of a reference signal from a time standard source, which is formed of a quartz oscillator, thereby implementing the indication of the correct time, which is the basic function of the timepieces.

The storage device for charging the generated power has a withstand voltage, and exceeding the withstand voltage of the storage device causes a deterioration in the characteristics, such as a decreased capacitance, or destruction and leakage due to expansion, which may lead to a fault in the timepiece having a built-in generator.

Thus, in order to prevent an unusual surge of the charging voltage of a storage device, a circuit, such as the one disclosed in Japanese Unexamined Patent Application Publication No. 21-236332, is used for a generator which generates power by the oscillation of an oscillating weight or a generator using a solar cell. According to this circuit, the voltage of the storage device is detected by a comparator, and when the voltage reaches a predetermined value, both ends of the generator are short-circuited so as to prevent any further current from flowing into the storage device. By the provision of this type of circuit, with an increase of the voltage of the storage device, the generator is short-circuited so as to interrupt the supply of power to the storage device, thereby preventing overcharging.

In the circuit disclosed in Japanese Unexamined Patent Application Publication No. 21-236332, however, since both ends of the generator are short-circuited, the waveform generated at both ends of the generator is deformed or the voltage level is reduced. Accordingly, by integrating the circuit disclosed in Japanese Unexamined Patent Application Publication No. 21-236332 in the above described electronically controlled mechanical timepiece, the rotational speed of the rotor cannot be correctly determined from the generated waveform, thereby failing to perform control of matching the rotational speed of the rotor to the reference signal of the time standard source. As a result, the time cannot be indicated correctly.

Accordingly, it is an object of the present invention to provide an electronically controlled mechanical timepiece in which overcharging of a storage device can be prevented and in which the time can be correctly indicated, and also to provide an overcharge-prevention method for the electronically controlled mechanical timepiece.

SUMMARY OF THE INVENTION

The present invention provides an electronically controlled mechanical timepiece including a mechanical energy source, a generator for outputting electrical energy and being driven by this mechanical energy source and by generating induction power, a storage device for storing the electrical energy output from the generator, and a rotation control device for controlling a rotation period of the generator and being driven by the electrical energy supplied from the storage device, the electronically controlled mechanical timepiece being characterized by comprising: a bypass circuit connected in parallel with the storage device with respect to the generator; a bypass circuit switch provided for the bypass circuit; and a voltage detection circuit for controlling this bypass circuit switch on and off according to a voltage of the storage device.

The electrical energy output from the generator is input into the storage device and is stored therein. In the present invention, the bypass circuit is provided in parallel with the storage device. Thus, when the voltage detection circuit turns on the bypass circuit switch of the bypass circuit according to the voltage of the storage device, the bypass circuit conducts so as to allow the electrical energy from the generator to flow into the bypass circuit. Accordingly, the current input into the storage device can be decreased so as to reduce the voltage of the storage device, thereby preventing the overcharging of the storage device.

Moreover, the input current into the storage device can be decreased without short-circuiting the generator so as to eliminate a deformation of the generated waveform and a reduction in the voltage level, thereby obtaining a generated waveform corresponding to the rotation period of the generator. Accordingly, since the rotation period of the generator can be correctly obtained from the generated waveform, the rotation period of the generator can be controlled highly precisely and reliably based on this generated waveform, thereby implementing the indication of the correct time.

An increase in the voltage of the storage device decreases the charging current into the storage device, and the braking effect is weakened, making it difficult to reserve the total required braking amount. In the present invention, however, when the voltage of the storage device exceeds the set voltage, the charging current flows into the bypass circuit, thereby interrupting the voltage surge of the storage device. A decrease of the braking effect, which would be caused by the charging current flowing into the storage device, can thus be prevented from being weakened, thereby reserving the overall required braking amount.

Additionally, when the timepiece is set in a test mode in which braking is not applied, the rotor may rotated at a high speed (for example, from two to ten times higher than the normal rotational speed). In this case, a generated current greater than a normal current is supplied from the generator to the storage device so as to increase the voltage. According to the present invention, however, an increase in the voltage can be prevented by allowing the charging current to flow in the bypass circuit, which serves as a limiter.

Further, since the voltage increase of the storage device can be prevented, the lifetime of the electronically controlled mechanical timepiece is prolonged. More specifically, in the electronically controlled mechanical timepiece, by reducing the wear of the mechanical energy source, such as a mainspring or the like, to a smallest possible level, the lifetime of the electronically controlled mechanical timepiece can be prolonged. In order to achieve this, the driving speed of the generator is desirably decreased to a minimal level. In this case, since the induction power is also reduced according to the decreased driving speed of the generator, it is also necessary to decrease the consumption power of the IC forming the circuit portion of the rotation control device, the voltage detection circuit, or the like which is driven by this induction power. In order to reduce the consumption power of the IC, it is necessary to reduce the thickness of the gate oxide film of the IC, which reduces the withstand voltage of the IC. This also requires that the voltage applied to the IC from the storage device should be suppressed to a lower level. In the present invention, therefore, since the voltage increase of the storage device can be prevented by the bypass circuit, an IC having a low withstand voltage, i.e., low power consumption, can be used as the IC forming the rotation control device or the like which is operated by the voltage from the storage device. Thus, in the electronically controlled mechanical timepiece, the provision of the bypass circuit in parallel with the storage device is very significant and meaningful because the driving speed of the generator can be decreased and the lifetime of the electronically controlled mechanical timepiece can be prolonged.

In this case, the rotation control device may preferably be provided with a circuit opening/closing device for disconnecting both terminals of the generator or for connecting the terminals in a closed loop state. As the rotation control device, a variable resistor or the like may be connected to the generator so as to change the current flowing in the coil of the generator, thereby adjusting the rotational speed. However, the circuit opening/closing device for switching between the closed loop state and the open loop state by connecting and disconnecting both terminals of the generator may be used. In this case, a closed loop may be formed across the terminals of the generator so as to apply braking by short-circuiting, thereby making it possible to perform brake control. It is thus possible to simplify the configuration of the rotation control device and to easily perform rotation control.

The rotation control device may preferably comprise control means for performing chopping control so that an opening/closing period in which the circuit opening/closing device is repeatedly connected and disconnected is shorter than a period of a rotation reference signal, which is a reference for the rotational speed of the generator. In this case, the voltage can be increased by chopping, thereby enhancing the induction power and also performing efficient brake control.

Moreover, the bypass circuit may preferably be disposed closer to the storage device than the circuit opening/closing device with respect to the generator. If the bypass circuit is disposed between the generator and the circuit opening/closing device, the circuit opening/closing device cannot perform rotation control while the bypass circuit switch is connected. If, however, the bypass circuit is disposed closer to the storage device than the circuit opening/closing device, i.e., at the side opposite to the generator with respect to the circuit opening/closing device, rotation control of the generator can be performed regardless of whether the bypass circuit switch is connected or disconnected. Additionally, the overcharging of the storage device can be reliably prevented.

The electronically controlled mechanical timepiece may preferably comprise a rectifier circuit for rectifying a current output from the generator, and the bypass circuit may be disposed closer to the storage device than the rectifier circuit with respect to the generator.

In this case, too, the bypass circuit does not interrupt the rectifying operation performed on the current output from the generator, and also, the overcharging of the storage device can be reliably prevented.

Further, a first end of the storage device may preferably be connected to a first end of the rectifier circuit connected to the generator, and a second end of the storage device may preferably be connected to a second end of the rectifier circuit, and the bypass circuit may preferably be disposed closer to the storage device than the circuit opening/closing device and the rectifier circuit with respect to the generator.

In this case, the bypass circuit does not interrupt the rotation control operation performed by the circuit opening/closing device and the rectifying operation performed by the rectifier circuit, and the overcharging of the storage device can be reliably prevented.

Still further, the first end of the rectifier circuit may preferably be formed of a first rectifier switch disposed between a first alternating current input terminal of the generator and the first end of the storage device, and a second rectifier switch disposed between a second alternating current input terminal of the generator and the first end of the storage device, and the circuit opening/closing device may preferably be formed of a first circuit opening/closing switch connected in parallel with the first rectifier switch, and a second circuit opening/closing switch connected in parallel with the second rectifier switch.

By separately providing a rectifier switch for the generator and a circuit opening/closing switch for switching both terminals of the generator between a disconnecting state and a closed loop state, rectify control and rotation control by the circuit opening/closing switch can be independently performed, thereby making it possible to easily perform both controls.

Additionally, the voltage detection circuit may desirably be driven by an output of the storage device. This obviates the need to provide a driving source specifically used for the voltage detection circuit, thereby enhancing the simplicity of the structure.

The voltage detection circuit may desirably be driven at regular intervals. By driving the voltage detection circuit intermittently in this manner, the consumption current of the voltage detection circuit can be reduced compared to when the voltage detection circuit is constantly driven, thereby enabling the efficient charging of the storage device.

Moreover, the voltage detection circuit may preferably be constantly driven when a detected voltage of the storage device exceeds a set value and the voltage detection circuit may preferably be driven at regular intervals when the detected voltage is not greater than the set value.

If the voltage detection circuit is driven at regular intervals, it is necessary that the resistance of the bypass circuit be increased to a certain degree in the case where the bypass circuit is turned on, so that the voltage does not considerably drop before the voltage is subsequently detected. This impairs the capacity of the bypass circuit for allowing the current to flow therein, and when the bypass circuit is connected because the voltage of the storage device exceeds a set value, it takes time to reduce the voltage to the set value.

On the other hand, as in the present invention, by constantly driving the voltage detection circuit when the voltage of the storage device exceeds a set value, the bypass circuit switch can be immediately turned off so as to interrupt the current from flowing into the bypass circuit when the voltage is reduced to the set value. It is thus possible to prevent the voltage of the storage device from being excessively reduced and to enhance the capacity of the bypass circuit for allowing the current to flow therein by reducing the resistance of the bypass circuit. The voltage detection circuit is driven at regular intervals when the voltage of the storage device is not greater than the set value. Accordingly, the consumption current when the voltage is low can be reduced, thereby making it possible to efficiently charge the storage device.

In this case, the voltage detection circuit may preferably comprise a comparator for turning on the bypass circuit switch when the detected voltage of the storage device exceeds the set value and for turning off the bypass circuit switch when the detected voltage is not greater than the set value, and a latch circuit disposed between this comparator and the bypass circuit switch so as to retain an output of the comparator.

The latch circuit is constantly operated so as to retain an output of the comparator. Consequently, the output of the comparator is retained by the latch circuit regardless of whether the comparator is on or off, i.e., even in the state in which the comparator is off, and the output from the latch circuit to the bypass circuit switch is continuously obtained.

More specifically, in the state in which the voltage detection circuit is off while it is driven at regular intervals, the output of the comparator to the bypass circuit switch is also discontinued. In this case, it is considered that the bypass circuit switch may be changed to a state different from the one instructed by the comparator. For example, when the bypass circuit switch is changed from the on state to the off state in the case where the voltage detection circuit is off, the bypass circuit is disconnected from the generator, which may make it difficult to sufficiently reduce the voltage of the storage device. On the other hand, when the bypass circuit switch is changed from the off state to the on state in the case where the voltage detection circuit is off, the bypass circuit is connected to the generator, which may reduce the charging efficiency of the storage device.

In contrast, in the present invention, the output of the comparator can be retained in the constantly driven latch circuit. Thus, the control state of the bypass circuit switch instructed by the comparator can be maintained even while the voltage detection circuit is turned off, thereby enabling highly precise and efficient on/off control of the bypass circuit switch.

In this case, the latch circuit may be operated according to a latch signal, and this latch signal may preferably be output at a first time interval (for example, every two seconds) when the voltage of the storage device is not greater than the set value, and the latch signal may preferably be output at a second time interval (for example, every one millisecond), which is shorter than the first time interval, when the voltage of the storage device exceeds the set value.

In this case, when the voltage of the storage device exceeds the set value, the output change of the comparator can be immediately reflected on the output from the latch circuit, thus making the circuit exhibit good response characteristics.

Also, the voltage detection circuit may preferably comprise voltage-dividing resistors for dividing the voltage of the storage device and for inputting the divided voltage into the comparator, a resistor switch for interrupting the supply of electrical energy from the storage device to the voltage-dividing resistors, a comparator switch for interrupting the supply of the electrical energy from the storage device to the comparator, and a drive unit for turning on the resistor switch and the comparator switch at regular intervals, and the comparator may preferably detect the voltage divided by the voltage-dividing resistors and compares it with the set value.

By providing the voltage-dividing resistors as described above, the voltage of the storage device is divided and is detected by the comparator. Then, the voltage input into the comparator can be adjusted according to the type of comparator. For example, when the set value (reference voltage) of the comparator is defined, the resistances of the voltage-dividing resistors are changed according to the magnitude of the set value so that the input voltage can correspond to the comparator. This enables the use of various known comparators.

As described above, the bypass circuit may desirably be provided with a resistor having a predetermined resistance. By providing this resistor, the charging current from the generator flows into the bypass circuit so as to decrease the current input into the storage device, and also, the charge stored in the storage device is discharged via the resistor so as to reduce the voltage of the storage device, thereby preventing the overcharging of the storage device more effectively.

The resistance may preferably range from about 100 kΩ to 10 MΩ when, for example, a 10 $\mu$F capacitor is used as the storage device, though it may vary by the capacitance of the storage device. If this resistance is an excessively small value, the charge stored in the storage device immediately after the bypass circuit switch is connected excessively flows into the bypass circuit, thereby causing a sharp voltage drop of the storage device. This sharp voltage drop may cause the occurrence of abnormalities and the stoppage of the electronically controlled mechanical timepiece. If the resistance is an excessively large value, the charging current flowing in the bypass circuit is decreased, and thus, the charging current flowing into the storage device cannot be significantly decreased, thereby hampering the degree of voltage reduction in the storage device. Thus, the resistance of the resistor is set so that the current flowing into the resistor is greater than the current flowing in the storage device so as to decrease the charging current flowing in the storage device, and that the voltage of the storage device does not sharply drop. With this arrangement, the current input into the storage device can be considerably reduced, and the charge of the storage device can be discharged, thereby efficiently reducing the voltage of the storage device in a short time.

Moreover, the bypass circuit may be provided with a diode. By providing a diode, the charging current from the generator is allowed to flow into the bypass circuit so as to prevent the overcharging of the storage device. It is also possible to prevent the current from flowing into the bypass circuit from the storage device immediately after the bypass circuit switch is connected, thereby preventing a sharp voltage drop of the storage device.

The bypass circuit may be part of the voltage detection circuit. The voltage detection circuit may preferably be provided with voltage-dividing resistors for dividing the voltage of the storage device, and the bypass circuit may preferably be formed by these voltage-dividing resistors.

By forming the bypass circuit as part of the voltage detection circuit, such as voltage-dividing resistors for dividing the voltage of the storage device, it is not necessary to specifically provide a resistor for the bypass circuit. This makes it possible to reduce the number of devices forming the circuit so as to make the circuit scale smaller, thereby achieving the miniaturization of the circuit and a reduction in the consumption power and the cost.

An overcharge-prevention method of the present invention is a method for an electronically controlled mechanical timepiece which includes a mechanical energy source, a generator for outputting electrical energy and being driven by this mechanical energy source and by generating induction power, a storage device for storing the electrical energy output from the generator, and a rotation control device for controlling a rotation period of the generator and being driven by the electrical energy supplied from the storage device. The overcharge-prevention method is characterized in that a bypass circuit is connected in parallel with the storage device with respect to the generator; and that the bypass circuit is electrically connected only when a detected voltage of the storage device exceeds a set value so as to decrease an input current into the storage device.

In this invention, the bypass circuit is electrically connected only when the detected voltage of the storage device exceeds the set value so as to input the electrical energy from the generator into both the storage device and the bypass circuit, thereby decreasing the input current into the storage device. With this arrangement, the voltage of the storage device can be restricted, thereby preventing the overcharging of the storage device.

Additionally, the input current into the storage device can be reduced without short-circuiting the generator, thereby preventing a deformation in the generated waveform and a reduction in the voltage level. Accordingly, the rotation period can be precisely controlled based on the generated waveform, thereby implementing the indication of the correct time.

In this case, the voltage of the storage device may preferably be detected at regular intervals.

With this arrangement, when the conducting state of the bypass circuit is controlled by the output of the storage device, the electrical energy required for controlling the bypass circuit switch can be reduced, thereby performing the efficient charging of the storage device.

The voltage may preferably be constantly detected when the detected voltage of the storage device exceeds the set value, and the voltage may preferably be detected at regular intervals when the detected voltage is not greater than the set value.

By constantly detecting the voltage when the detected voltage of the storage device exceeds the set value, the bypass circuit switch can be immediately turned off when the voltage is reduced to the set value or lower, thereby interrupting the current from flowing in the bypass circuit. It is thus possible to prevent the voltage of the storage device from being reduced to an excessively low value. Further, since the voltage detection circuit is driven at regular intervals when the voltage of the storage device is not greater than the set value, the current consumption when the voltage is low can be reduced, thereby efficiently charging the storage device. In particular, the voltage detection circuit is constantly driven only when the voltage of the storage device exceeds the set value and when an influence of power consumption is very little, thereby making it possible to efficiently control the power consumption.

BRIEF DESCRIPTION OF THE DRAWINGS

In the drawings, wherein like reference symbols refer to like parts.

DETAILED DESCRIPTION

A first embodiment of the present invention is described below with reference to the drawings.

Figure 1:
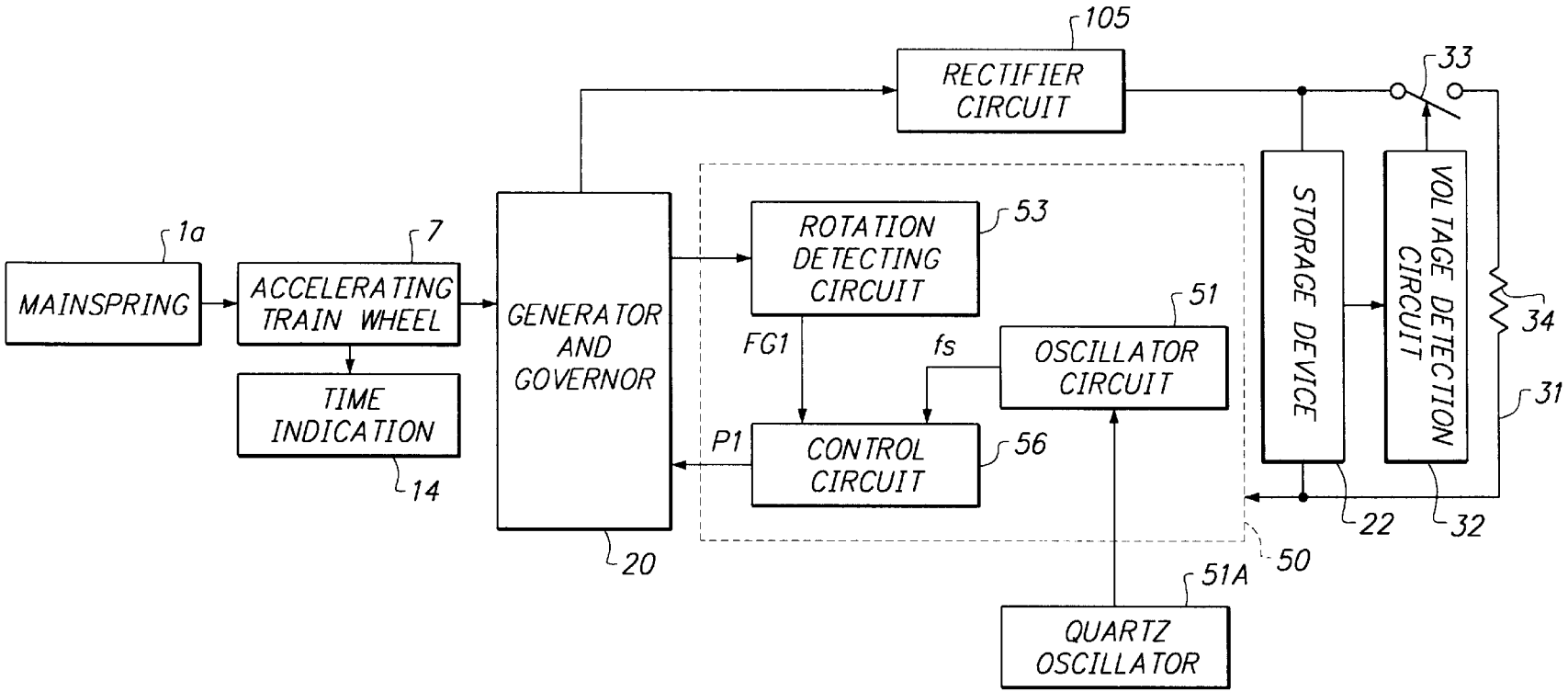
FIG. 1 is a block diagram illustrating an electronically controlled mechanical timepiece according to a first embodiment of the present invention.

FIG. 1 is a block diagram illustrating the configuration of an electronically controlled mechanical timepiece of this embodiment.

The electronically controlled mechanical timepiece is provided with a mainspring 1*a*, which serves as a mechanical energy source, a speed-increasing wheel train (wheel) 7, which serves as a mechanical energy transfer device for transferring a torque of the mainspring 1 to a generator 20, and hands 14, which serve as a time indicating device for indicating the time, connected to the speed increasing wheel train 7.

The generator 20 is driven by the mainspring 1*a* via the accelerating train wheel 7 so as to generate induction power, thereby supplying electrical energy. An AC output from the generator 20 is boosted and rectified via a rectifier circuit 105 formed of a step-up rectifier, a full-wave rectifier, a half-wave rectifier, a transistor rectifier, or the like, and is charged and supplied to a capacitor (storage device) 22. In accordance with the voltage of the capacitor 22, the output of the generator 20 is also supplied to a bypass circuit 31.

Figure 2:
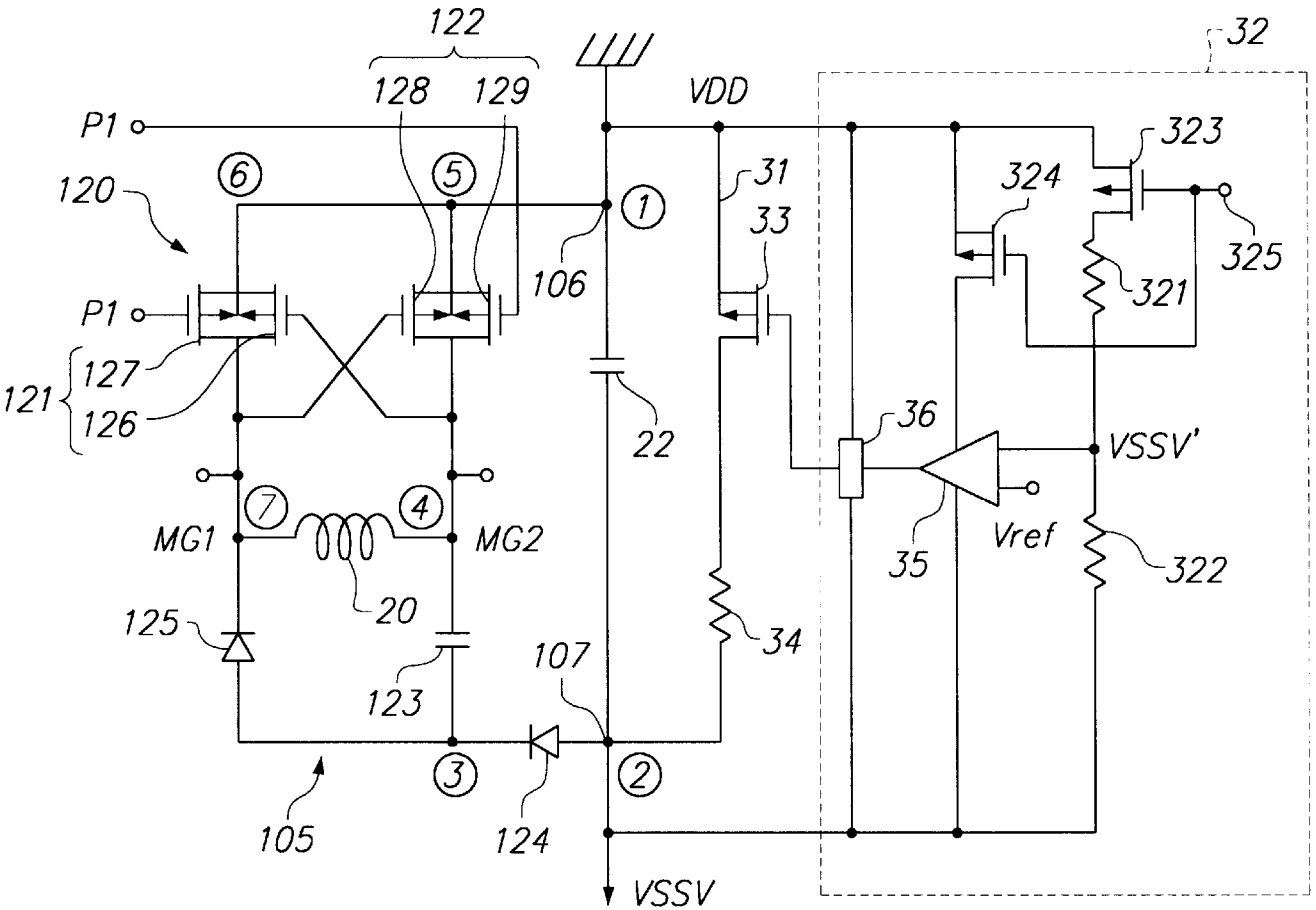
FIG. 2 is a circuit diagram illustrating a rectifier circuit, a storage device, and a voltage detection circuit of the above described first embodiment.

As shown in FIG. 2, a braking circuit 120 is integrated into the generator 20, which also serves as a governor.

This braking circuit 120 has a first switch 121 connected to a first AC input terminal MG1 into which an AC (alternating current) signal generated in the generator 20 is input, and a second switch 122 connected to a second AC input terminal MG2 into which an AC signal is input.

The first switch 121 is formed by connecting a first Pch field effect transistor 126 and a second field effect transistor 127 in parallel with each other, the first Pch field effect transistor (FET) 126 being connected at its gate to the second AC input terminal MG2, and the second field effect transistor 127 having a gate into which a chopping signal (chopping pulse) P1 from a control circuit 56, which is described below, is input.

The second switch 122 is formed by connecting a third Pch field effect transistor (FET) 128 and a fourth field effect transistor 129 in parallel with each other, the third Pch field effect transistor 128 being connected at its gate to the first AC input terminal MG1, and the fourth field effect transistor 129 having a gate into which a chopping signal (chopping pulse) P1 from the control circuit 56 is input.

The first field effect transistor 126 is connected when the polarity of the AC input terminal MG2 is "negative", while the third field effect transistor 128 is connected when the polarity of the AC input terminal MG1 is "negative". That is, one of the transistors 126 and 128 connected to the terminal MG2 or MG1 of the generator with "positive" polarity is switched on, while the other transistor is switched off, thereby forming part of the rectifier circuit. Accordingly, a first rectifying switch is formed by the field effect transistor 126, while a second rectifying switch is formed by the field effect transistor 128.

The second field effect transistor 127 and the fourth field effect transistor 129 connected in parallel to the transistors 126 and 128, respectively, are controlled on and off by the same chopping signal P1. Thus, in simultaneously turning on the transistors 127 and 129 by the chopping signal P1, a closed loop is formed between the first and second AC input terminals MG1 and MG2 due to, for example, short circuiting, regardless of the states of the transistors 126 and 128, which serve as rectifying switches, thereby applying braking to the generator 20 by short-circuiting. Thus, a circuit opening/closing device for disconnecting across both terminals MG1 and MG2 of the generator 20 or connecting the terminals MG1 and MG2 in a closed loop is formed by the field effect transistor 127, which serves as a first circuit opening/closing switch, and the field effect transistor 129, which serves as a second circuit opening/closing switch.

A voltage-doubler rectifier circuit (simple-type synchronizing-and-boosting chopping rectifier circuit) 105 (the rectifier circuit 105 shown in FIG. 1) is formed by a step-up capacitor 123, diodes 124 and 125, the first switch 121, and the second switch 122, which are connected to the generator 20. Any type of diode can be used for the diodes 124 and 125 as long as it is a unidirectional device for causing a current to flow in a single direction. In particular, in the electronically controlled mechanical timepiece, the induction voltage of the generator 20 is small so that a Schottky barrier diode having a small voltage drop Vf may preferably be used as the diode 125. As the diode 124, a silicon diode having a small reverse leakage current may preferably be used.

A DC signal rectified by this rectifier circuit 105 charges the capacitor 22 via a first DC output terminal 106 and a second DC output terminal 107 of the rectifier circuit 105.

The above-described braking circuit 120 is controlled by a rotation control device 50, which is an electronic circuit driven by power supplied form the capacitor 22. This rotation control device 50 is formed of, as shown in FIG. 1, an oscillator circuit 51, a rotor-rotation detecting circuit 53, and a brake control circuit 56.

The oscillator circuit 51 outputs an oscillation signal (32768 Hz) by using a quartz oscillator 51A, which serves as a time standard source, and this oscillation signal is scaled to a certain constant period by a scaling circuit (not shown) consisting of a 12-stage flip-flop. The 12th output of this scaling circuit is output to the control circuit 56 as an 8 Hz reference signal fs.

The rotation detecting circuit 53 is formed of a waveform shaping circuit connected to the generator 20 and a monostable multivibrator, and detects the rotational speed of the rotor from a waveform output from the generator 20. The waveform shaping circuit, which is used for converting a square wave to a rectangular wave, is formed of an amplifier, comparator, and so on. The monostable multivibrator serves as a band pass filter which only passes pulses of a certain period or lower, and outputs a rotation detection signal FG1, with noise eliminated, to the control circuit 56.

The control circuit 56 is provided with an up/down counter, a synchronizing circuit, and the above-described chopping signal generator, though they are not shown.

An up-count signal based on the rotation detection signal FG1, of the rotation detecting circuit 53 and a down-count signal based on the reference signal fs from the scaling circuit are input into the up/down counter via the synchronizing circuit, thereby simultaneously counting the reference signal fs and the rotation detection signal FG1 and the difference therebetween.

When the count value based on the counts of the up-count signal and the down-count signal is equal to or greater than a predetermined value, the output from the up/down counter to the chopping signal generator is an H level signal. When the above-mentioned count value is less than the predetermined value, the output of the up/down counter is an L level signal. The count value is incremented when the up-count signal is input, and is decremented when the down-count signal is input.

The synchronizing circuit synchronizes the rotation detection signal FG1 to the reference signal fs (8 Hz) by using the signal of the output from the fifth stage (1024 Hz) and the signal of the output from the sixth stage (512 Hz) of the above described scaling circuit. The synchronizing circuit also makes an adjustment in such a manner that the above-mentioned signal pulses are output without overlapping with each other.

The chopping signal generator is configured to output the chopping signal P1 by utilizing the output of the scaling circuit, and the output chopping signal P1 is input, as illustrated in FIG. 2, into the gates of the Pch field effect transistors 127 and 129.

With this configuration, when the L level signal is output from the output P1, the transistors 127 and 129, i.e., the switches 121 and 122, are maintained in the on state, thereby applying braking to the generator 20 by short-circuiting. On the other hand, when the H level signal is output from the output P1, the transistors 127 and 129 are maintained in the off state, and thus, braking is not applied to the generator 20. Accordingly, the generator 20 can be chopping-controlled by the chopping signal from the output P1, and the rotation control device 50 including the chopping signal generator for generating this chopping signal forms a control device (control means) for intermittently chopping-controlling the switches 121 and 122 (transistors 127 and 129, which are circuit opening/closing switches).

The capacitor 22 and the bypass circuit 31 are connected, as shown in FIGS. 1 and 2, in parallel with the generator 20 which is brake-controlled as described above.

The bypass circuit 31 is provided with a bypass circuit switch 33, which is formed of a Pch transistor turned on or off according to the voltage of the capacitor 22, and a resistor 34.

This resistor 34 adjusts the ratio of the current flowing in the bypass circuit 31, i.e., the amount of current flowing into the capacitor 22, and also serves the function of reducing the voltage of the capacitor 22 by discharging the charge stored in the capacitor 22. In this embodiment, the resistance of the resistor 34 is set so that the current flowing in the resistor 34 is greater than that flowing in the capacitor 22 and so that the voltage of the capacitor 22 does not sharply drop. For example, in using a 10 $\mu$F capacitor 22, the resistance is set to range from about 100 kΩ to 10 MΩ. Accordingly, the resistor 34 of this embodiment decreases the charging current flowing in the capacitor 22 and also discharges the charge stored in the capacitor 22, thereby making it possible to drop the voltage of the capacitor 22 in a short time.

A voltage detection circuit 32 driven by an output of the capacitor 22 is connected to the capacitor 22.

This voltage detection circuit 32 controls the on/off state of the bypass circuit switch 33 of the bypass circuit 31 according to the voltage of the capacitor 22, and is provided with a comparator 35. The comparator 35 detects the voltage input from the capacitor 22. When the detected voltage VSSV' exceeds a preset value Vref, the comparator 35 outputs a signal (low level signal) which turns on the bypass circuit switch 33. When the detected voltage VSSV' is not greater than the preset value Vref, the comparator 35 outputs a signal (high level signal) which turns off the bypass circuit switch 33.

The voltage detection circuit 32 is provided with two voltage-dividing resistors 321 and 322 for dividing the voltage VSSV of the capacitor 22 and inputting the divided voltage into the comparator 35, a resistor switch 323 for interrupting the supply of electrical energy from the capacitor 22 to the voltage-dividing resistors 321 and 322, a comparator switch 324 for interrupting the supply of electrical energy from the capacitor 22 to the comparator 35, and a drive unit 325 for switching on the resistor switch 323 and the comparator switch 324 at fixed intervals.

In the above-described voltage detection circuit 32, the voltage VSSV of the capacitor 22 is divided by the voltage-dividing resistors 321 and 322, and the divided voltage is detected in the comparator 35 and compared with the preset value Vref. As a result of the comparison, the bypass circuit switch 33 is controlled on and off.

Since the voltage of the capacitor 22 is divided and input into the comparator 35 as discussed above, the value Vref of the comparator 35 is set to be a divided value of a preset limit voltage of the capacitor 22. For example, it is now assumed that the resistances of the voltage-dividing resistors 321 and 322 are set to be 1 MΩ and 800 kΩ, respectively, so as to divide the voltage of the capacitor 22 in the ratio 10:8. In this case, if the limit voltage of the capacitor 22 is set to be 1.8 V so as to prevent the voltage of the capacitor 22 from exceeding 1.8 V, the set value Vref of the comparator 35 is 1.0 V.

The drive unit 325 is set so that it repeatedly switches on and off at regular intervals, thereby causing the capacitor 22 to simultaneously supply the electrical energy to the voltage-dividing resistors 321 and 322 and the comparator 35 at fixed intervals. Accordingly, the comparator 35 alternately repeats being driven and stopping.

A latch circuit 36 for latching the output of the comparator 35 is provided between the comparator 35, which is intermittently driven as described above, and the switch 33 of the bypass circuit 31. The latch circuit 36, which latches the output of the comparator 35, is constantly and continuously driven by the output of the capacitor 22. Thus, even if the operation of the comparator 35 is discontinued, the latch circuit 36 is able to latch the output state which was obtained immediately before the comparator 35 has been stopped until a subsequent output is obtained.

With respect to the generator 20, the bypass circuit 31 is placed closer to the capacitor 22 than the switches 121 and 122 including the transistors 127 and 129, respectively, which serve as the circuit opening/closing device. In other words, the switches 121 and 122 are disposed between the generator 20 and the bypass circuit 31.

With respect to the generator 20, the bypass circuit 31 is placed closer to the capacitor 22 than the rectifier circuit 105, namely, the rectifier circuit 105 is disposed between the generator 20 and the bypass circuit 31.

The capacitor 22 is connected at one end to the first DC output terminal 106 of the rectifier circuit 105 and at its other end to the second DC output terminal 107 of the rectifier circuit 105. The bypass circuit 31 is also connected to the terminals 106 and 107.

The operation of this embodiment is discussed below.

Upon starting to operate the generator 20, in the control circuit 56, an up-count signal based on the rotation detection signal FG1 output from the rotation detecting circuit 53 and a down-count signal based on the reference signal fs output from the scaling circuit are input into the up/down counter and are counted. In this case, the synchronizing circuit adjusts the output in such a manner that the signals are not simultaneously input into the counter.

When the up-count signal is input into the up/down counter and the count value becomes equal to or greater than a predetermined value, the output into the chopping signal generator results in an H level signal. On the other hand, when the down-count signal is input and the count value becomes smaller than the predetermined value, the output results in an L level signal.

Based on the output of the up/down counter, the chopping signal generator outputs the output P1 by utilizing the output of the scaling circuit. More specifically, when the L level signal is output from the up/down counter, the output P1 from the chopping signal generator to the transistors 127 and 129 of the respective switches 121 and 122 results in a chopping signal having a small duty ratio (the ratio of the activated time of the switches 121 and 122), i.e., a signal having a longer H level signal (brake-off time) and a shorter L level signal (brake-on time). Thus, the brake-on time in the reference period is shorter, and almost no braking is applied to the generator 20, namely, weak braking control is performed on the generator 20 while giving priority to generated power.

In contrast, when the H level signal is output from the up/down counter, the output P1 of the chopping signal generator results in a chopping signal having a large duty ratio, i.e., a chopping signal having a longer L level signal (brake-on time) and a shorter H level signal (brake-off time). Consequently, the brake-on time in the reference period is longer, and strong braking control exhibiting a large braking force is performed on the generator 20. However, since braking is turned off at regular intervals, chopping control is performed, thereby making it possible to enhance the braking torque while inhibiting a reduction in the generated power.

Both the output of the up/down counter and the chopping signal utilize the output of the scaling circuit, namely, the frequency of the chopping signal P1 is an integral multiple of the frequency of the output of the scaling circuit. Accordingly, a change of the output level, i.e., the switching timing of the strong braking control and the weak braking control, is generated while synchronizing with the chopping signal P1. Further, the voltage-doubler rectifier circuit (simple-type synchronizing-and-boosting chopping rectifier circuit) 105 stores the charge generated in the generator 20 in the capacitor 22 as follows.

More specifically, when the polarity of the first AC input terminal MG1 is "negative", and the polarity of the second AC input terminal MG2 is "positive", the first field effect transistor (FET) 126 is switched off, and the third field effect transistor (FET) 128 is switched on. Accordingly, the induction voltage charge generated in the generator 20 is stored in, for example, the 0.1 $\mu$F capacitor 123, by the circuit "④→③→⑦" shown in FIG. 2, and is stored in, for example, the 10 $\mu$F capacitor 22 by the circuit "④→⑤→①→②→③→⑦→④→"

On the other hand, when the polarity of the first AC input terminal MG1 is switched to "positive", and the polarity of the second AC input terminal MG2 is switched to "negative", the first field effect transistor (FET) 126 is turned on, and the third field effect transistor (FET) 128 is turned off. Accordingly, with the total voltage of the induction voltage generated in the generator 20 and the charging voltage of the capacitor 123, the capacitor 22 is charged by the circuit "capacitor 123→④→⑦ → ⑥→ ⑤→ ①→ ②→③→capacitor 123→④→⑦→" shown in FIG. 2.

In this case, in each state, both ends of the generator 20 are short-circuited by the chopping pulse P1 and are unwound so as to induce a high voltage at both ends of the coil of the generator 20. By this high charging voltage, the storage device (capacitor) 22 can be charged. Thus, the charging efficiency can be improved.

AC waveforms are output from MG1 and MG2 of the generator 20 in accordance with a change in the magnetic flux. Simultaneously, the chopping signals P1 having a fixed frequency and different duty ratios are suitably applied to the switches 121 and 122 (transistors 127 and 129) according to the output signal of the generator 20. When the up/down counter outputs the H level signal, i.e., when strong braking control is performed, the braking time by short-circuiting in each chopping period becomes longer so as to increase the amount by which braking is applied, thereby decreasing the speed of the generator 20. Meanwhile, the amount of generated power is decreased according to the amount of braking applied. However, the energy stored during this braking by short-circuiting can be output when the switches 121 and 122 (transistors 127 and 129) are turned off by the chopping signal P1, thereby boosting the voltage by chopping. As a result, a decrease in the generated power during braking by short-circuiting can be compensated for, so that the braking torque can be increased while inhibiting a reduction in the generated power.

Conversely, when the up/down counter outputs the L level signal, i.e., when weak braking control is performed, the braking time by short-circuiting in each chopping period becomes shorter so as to decrease the amount by which braking is applied, thereby increasing the speed of the generator 20. In this case, as well as in the previous case, when the switches 121 and 122 are changed from the on state to the off state by the chopping signal P1, the voltage can be boosted by chopping. Thus, the generated power can be improved even in comparison with the power generated when no braking is applied at all.

The AC output from the generator 20 according to the above-described power generation is boosted and rectified in the voltage-doubler rectifier circuit 105, and is then charged in the capacitor 22. The rotation control device 50 is then driven by the output from this capacitor 22.

Meanwhile, in the voltage detection circuit 32, the resistor switch 323 and the comparator switch 324 are turned on at regular intervals by the drive unit 325, thereby intermittently supplying electrical energy from the capacitor 22 to the voltage-dividing resistors 321 and 322 and to the comparator 35 at regular intervals.

That is, upon switching on the individual switches 323 and 324, the voltage VSSV of the capacitor 22 is divided by the voltage-dividing resistors 321 and 322 and is input into the comparator 35. The comparator 35 detects the input voltage and compares the detected voltage VSSV' with the set value Vref.

When the detected voltage VSSV' exceeds the set value Vref, namely, when the voltage of the capacitor 22 exceeds a limit voltage corresponding to the set value Vref, the output of the capacitor 22 is inverted from the high level to the low level. This output is input and latched in the latch circuit 36 and is further input into the bypass circuit switch 33. Then, the bypass circuit switch 33, which is formed of a Pch transistor, is turned on so as to electrically connect the bypass circuit 31, thereby causing a current to flow from the power supply VDD to the power supply VSSV via the resistor 34. In this case, the current flowing in the bypass circuit 31 is greater than the charging current flowing into the capacitor 22 due to the resistance of the resistor 34. As the bypass circuit 31 is electrically connected in this manner, the input current into the capacitor 22 is decreased, and the charge stored in the capacitor 22 is discharged via the resistor 34, thereby gradually reducing the voltage of the capacitor 22 to the limit voltage or lower.

In contrast, when the detected voltage VSSV' is not greater than the set value Vref, namely, when the voltage of the capacitor 22 is not greater than the limit voltage, the output of the comparator 35 becomes a high level so as to turn off the bypass circuit switch 33, thereby disconnecting the bypass circuit 31. Accordingly, the electrical energy output from the generator 20 flows into the capacitor 22 and is charged therein rather than flowing into the bypass circuit 31.

The power is supplied to the comparator 35 and to the voltage-dividing resistors 321 and 322 at regular intervals by the switching of the resistor switch 323 and the comparator switch 324 by the drive unit 325. Thus, the output from the comparator 35 to the bypass circuit switch 33 is electrically connected at regular intervals. In this case, in the state in which the output of the comparator 35 is stopped, i.e., the power supply to the comparator 35 is interrupted, the output obtained immediately before the power supply was interrupted is latched in the latch circuit 36, and the state of the bypass circuit switch 33 is maintained until a subsequent input is obtained.

Figure 3:
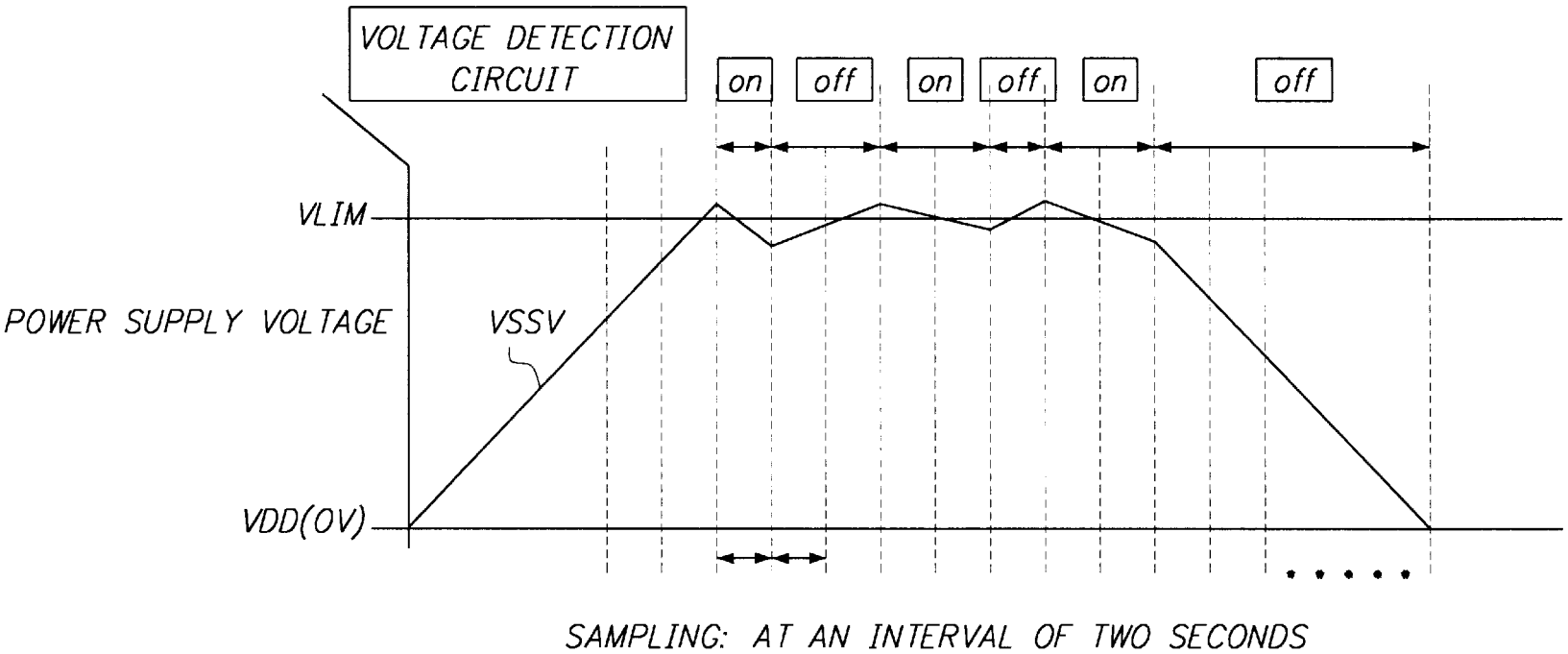
FIG. 3 is a diagram illustrating a change of the power supply voltage over time in the above describe first embodiment.

For example, when the resistor switch 323 and the comparator switch 324 are turned on every two seconds, on/off control (sampling) of the bypass circuit switch 33 is conducted, as shown in FIG. 3, every two seconds at which the switches 323 and 324.are turned on. The obtained on/off state of the switch 33 is maintained for two seconds while the switches 323 and 324 are turned off, i.e., while sampling is interrupted. When an on/off instruction is input from the comparator 35 in conducting subsequent sampling, the previous instruction is cleared, and the bypass circuit switch 33 is switched on or off based on the new instruction.

As discussed above, in this embodiment, the input current into the capacitor 22 is controlled so that the voltage VSSV (power supply voltage) of the capacitor 22 does not exceed a predetermined limit voltage VLIM.

According to the aforementioned embodiment, the following advantages are offered.

(1) The capacitor 22 and the bypass circuit 31 are connected in parallel with each other with respect to the generator 20, and the electrical energy from the generator 20 is supplied to the bypass circuit 31 according to the voltage of the capacitor 22, thereby decreasing the current input into the capacitor 22. This makes it possible to reduce the voltage of the capacitor 22, thereby preventing the capacitor 22 from being overcharged.

Additionally, the input current into the capacitor 22 can be decreased while the generator 20 is generating, thereby preventing the generated waveform from being deformed and the voltage level from being reduced. This enables the rotation detecting circuit 53 to detect the generated waveform which precisely reflects the rotation period of the generator 20. As a consequence, a high-precision rotation detection signal FG1 can be obtained so as to enable the rotation control device 50 to implement correct and high-precision rotation control based on the rotational state of the generator 20, thereby achieving the indication of the correct time.

(2) The voltage detection circuit 32 is driven by the output of the capacitor 22 so as to eliminate the provision of a driving source for the voltage detection circuit, thereby enhancing the simplicity of the structure.

(3) The voltage detection circuit 32 is configured to be driven at regular intervals so as to reduce the consumption current of the voltage detection circuit 32 compared to that when the voltage detection circuit 32 is constantly driven, thereby improving the charging efficiency of the capacitor 22.

(4) The voltage detection circuit 32 is provided with the latch circuit 36 for latching the output of the comparator 35. Thus, even while the voltage detection circuit 32 is stopped, the state of the bypass circuit switch 33 controlled by the comparator 35 can be maintained, thereby controlling the bypass circuit switch 33 on or off highly precisely and efficiently.

(5) Further, the voltage detection circuit 32 is provided with the voltage-dividing resistors 321 and 322 for dividing the voltage of the comparator 35, and the comparator 35 detects the voltage VSSV' divided by the voltage-dividing resistors 321 and 322 and compares it with the set value Vref. Thus, by varying the resistances of the voltage-dividing resistors 321 and 322 according to the type of comparator 35, the input voltage into the comparator 35 can be adjusted. This enables the use of various known comparators.

(6) The bypass circuit 31 is provided with the resistor 34 having a predetermined resistance. This makes it possible to prevent the charge stored in the capacitor 22 from abruptly flowing into the bypass circuit 31 immediately after the bypass circuit switch 33 is turned on, which would otherwise sharply reduce the voltage of the capacitor 22. As a result, it is possible to prevent the occurrence of abnormalities and the stoppage of the electronically controlled mechanical timepiece caused by a sharp voltage drop.

(7) The resistance of the resistor 34 is set so that the current flowing in the resistor 34 is greater than that flowing in the capacitor 22. Accordingly, the current input into the capacitor 22 can be significantly decreased, thereby efficiently reducing the voltage of the capacitor 22 in a short time. Moreover, since the charge stored in the capacitor 22 can be discharged by the resistor 34, the voltage of the capacitor 22 can be efficiently reduced in an even shorter time.

(8) The voltage-doubler rectifier circuit (simple-type synchronizing-and-boosting chopping rectifier circuit) 105 performs rectify control by using the first and third field effect transistors 126 and 128 whose gates are connected to the terminals MG2 and MG1, respectively, thereby eliminating the need for the provision of a comparator, etc. Thus, the structure can be made simple, thereby decreasing the number of parts and preventing a decrease in the charging efficiency caused by the power consumed by a comparator. Additionally, the field effect transistors 126 and 128 are controlled on and off by utilizing the terminal voltages (voltages of the AC input terminals MG2 and MG1) of the generator 20. Thus, the field effect transistors 126 and 128 can be controlled in synchronization with the polarity of the terminals of the generator 20, thereby improving the rectifying efficiency.

(9) By connecting the second and fourth field effect transistors 127 and 129, which are chopping-controlled, in parallel with the transistors 126 and 128, respectively, chopping control can be performed individually, and the construction can be made simple. It is thus possible to provide a simply constructed voltage-doubler rectifier circuit (simple-type synchronizing-and-boosting chopping rectifier circuit) 105 which can perform chopping-rectifying while synchronizing with the polarity of the generator 20 and boosting the generator 20.

(10) In the rectifier circuit 105, not only boosting by using the capacitor 123, but also boosting by chopping can be performed, thereby increasing the DC output voltage of the rectifier circuit 105, i.e., the charging voltage into the capacitor 22.

(11) Since braking control is conducted by using two types of chopping signals having different duty ratios, braking (braking torque) can be increased without reducing the charging voltage (generation voltage). Particularly when strong braking control is performed, a chopping signal having a large duty ratio is used, thereby increasing the braking torque without reducing the charging voltage. Consequently, efficient braking control can be performed while maintaining the stability of the system, thereby prolonging the life of the electronically controlled mechanical timepiece.

(12) As in the case of strong braking control, when weak braking control is performed, a chopping signal having a small duty ratio is used, thereby enhancing the charging voltage when weak braking control is performed.

(13) The provision of the bypass circuit 31 prevents the capacitor 22 from being overcharged, which would otherwise excessively increase the voltage of the capacitor 22. Accordingly, it is possible to prevent a decrease in the charging current, which would otherwise weaken the braking effect. Thus, the overall required braking amount can be maintained.

(14) Even when the timepiece is set in a test mode in which braking is not applied so as to supply a generated current greater than a normal current from the generator 20 to the capacitor 22, the charging current can flow in the bypass circuit 31, thereby reliably preventing the capacitor 22 from being overcharged.

(15) Since the overcharging of the capacitor 22 can be inhibited, an IC having a low withstand voltage, i.e., a low power consumption, can be used as an IC forming the rotation control device 50 driven by the capacitor 22. This makes it possible to decrease the driving speed of the generator 20 so as to lessen the wear of the mainspring 1*a*, thereby prolonging the lifetime of the electronically controlled mechanical timepiece.

(16) With respect to the generator 20, the bypass circuit 31 is placed closer to the capacitor 22 than the switches 121 and 122 (transistors 127 and 129), which serve as a circuit opening/closing device, and the rectifier circuit 105. Thus, even when the bypass circuit 31 is operating, the rotation control operation performed by the circuit opening/closing device and the rectifying operation performed by the rectifier circuit 105 cannot be interrupted, and the overcharging of the capacitor 22 can be reliably prevented.

Figure 4:
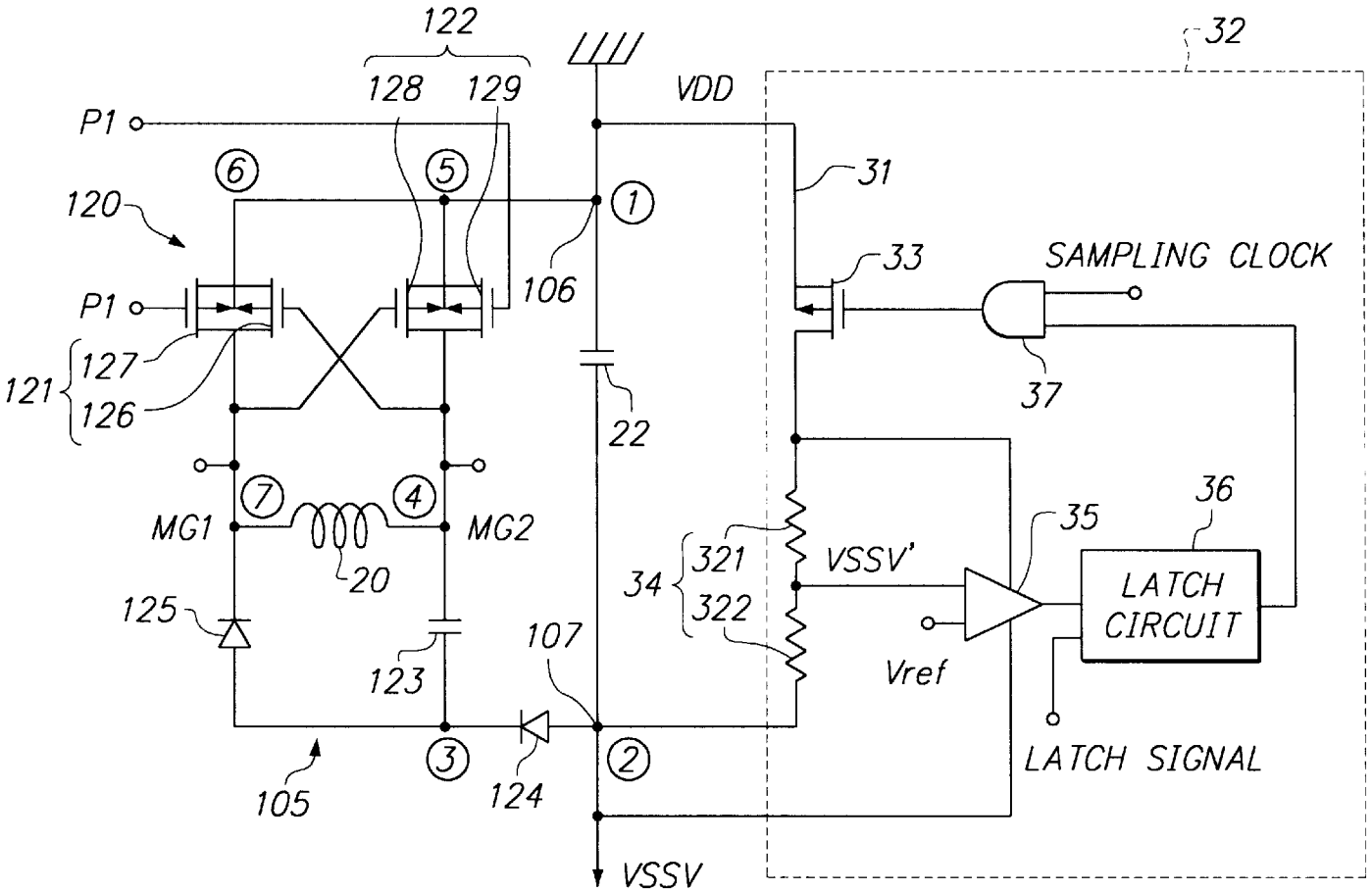
FIG. 4 is a circuit diagram illustrating a rectifier circuit, a storage device, and a voltage detection circuit of an electronically controlled mechanical timepiece according t a second embodiment of the present invention.

A second embodiment of the present invention is described below with reference to FIGS. 4 through 6. In this embodiment, the bypass circuit 31 of the first embodiment is formed by part of the voltage detection circuit 32, and more specifically, by using the voltage-dividing resistors 321 and 322.

More specifically, in this embodiment, the bypass circuit 31 is formed by connecting the voltage-dividing resistors 321 and 322 in series with the bypass circuit switch 33. The comparator 35 compares the voltage VSSV' across the voltage-dividing resistors 321 and 322 with the set value Vref, and outputs the comparison result to the latch circuit 36.

Since the power which drives the comparator 35 is supplied via the bypass circuit switch 33, the comparator 35 is driven only when the bypass circuit switch 33 is connected. More specifically, the bypass circuit switch 33 is turned on or off, as also shown in FIG. 4, by an output of an AND circuit 37 into which an output of the latch circuit 36 and a sampling clock are input. The sampling clock outputs a low level signal at an interval of a first setting time, that is, every two seconds, as shown in FIGS. 5 and 6, so as to connect the bypass circuit switch 33.

As in the first embodiment, the latch circuit 36 retains the output of the comparator 35. In this embodiment, however, the latch circuit 36 is operated by a latch signal. In this case, the latch signal is output according to the timing (every two seconds) at which the voltage detection circuit 32, and more specifically, the comparator 35, is operating. While a high level signal, which is output from the comparator 35 when the detected voltage VSSV' exceeds Vref, is input into the latch circuit 36, the latch signal is output at an interval of a second setting time, i.e., every 1 millisecond.

According to this embodiment constructed as described above, in the voltage detection circuit 32, the bypass circuit switch 33 is first turned on every two seconds by the sampling clock input into the AND circuit 37. Accordingly, a current flows into the bypass circuit 31 so as to drive the comparator 35. Then, as in the first embodiment, the voltage VSSV of the capacitor 22 is divided by the voltage-dividing resistors 321 and 322 and is input into the comparator 35. The comparator 35 then detects the input voltage and compares the detected voltage VSSV' with the set value Vref.

When the detected voltage VSSV' exceeds the set value Vref, i.e., when the voltage of the capacitor 22 exceeds a limit voltage corresponding to the set value Vref, the output of the comparator 35 is inverted from a high level to a low level. This output is input into the latch circuit 36 and is retained, and is further input into the AND circuit 37. In this case, since the signal from the latch circuit 36 is a low level signal, a low level signal is continuously output from the AND circuit 37 regardless of a change of the sampling clock. Accordingly, the bypass circuit switch 33, which is formed of a Pch transistor, is maintained in the on state so that the bypass circuit 31 is maintained in the conducting state. Thus, a current flows from the power supply source VDD to the power supply source VSSV via the voltage-dividing resistors 321 and 322. That is, the voltage-dividing resistors 321 and 322 connected in series to each other serve as the resistor 34 for the bypass circuit 31 used in the first embodiment. The resistances of the resistors 321 and 322 are suitably set, for example, the overall resistance of the series-connected resistors 321 and 322 may be set ranging from about 100 Ω to 10 MΩ, and more preferably, about a few hundred kΩ (for example, 800 kΩ) so as to particularly prevent a sharp voltage change in the current flowing in the bypass circuit 31. The resistances of the individual resistors 321 and 322 are suitably set in a range which satisfies the 35 condition for the above-described overall resistance and according to the dividing ratio.

In this case, the current flowing in the bypass circuit 31 is greater than the charging current flowing into the capacitor 22 by the voltage-dividing resistors 321 and 322. As the bypass circuit 31 conducts, as discussed above, the input current into the capacitor 22 is decreased, and the charge stored in the capacitor 22 is discharged via the voltage-dividing resistors 321 and 322. The voltage of the capacitor 22 is thus gradually decreased to a limit voltage or lower.

Figure 5:
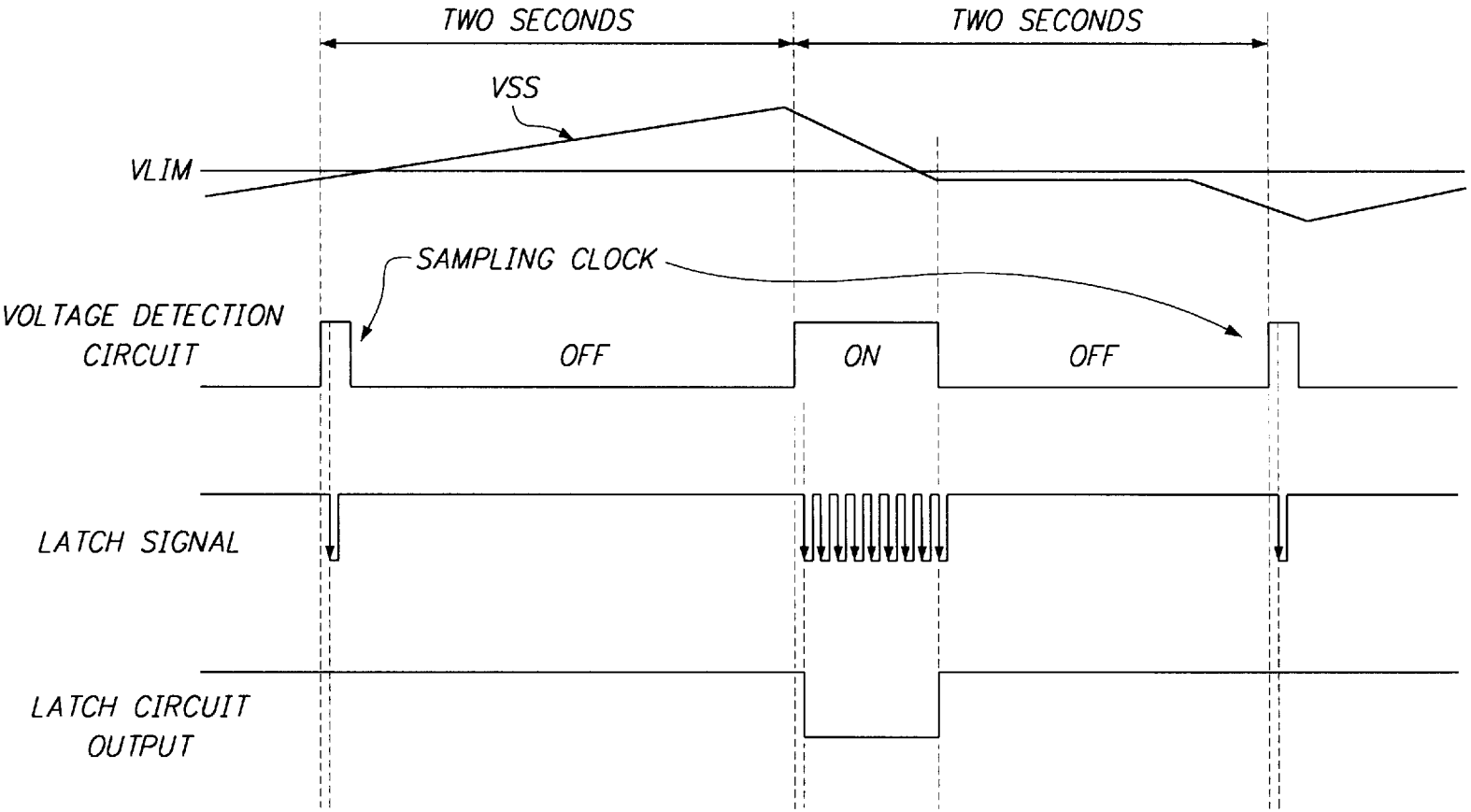
FIG. 5 is a timing chart illustrating the operation of the voltage detection circuit of the above described second embodiment.
Figure 6:
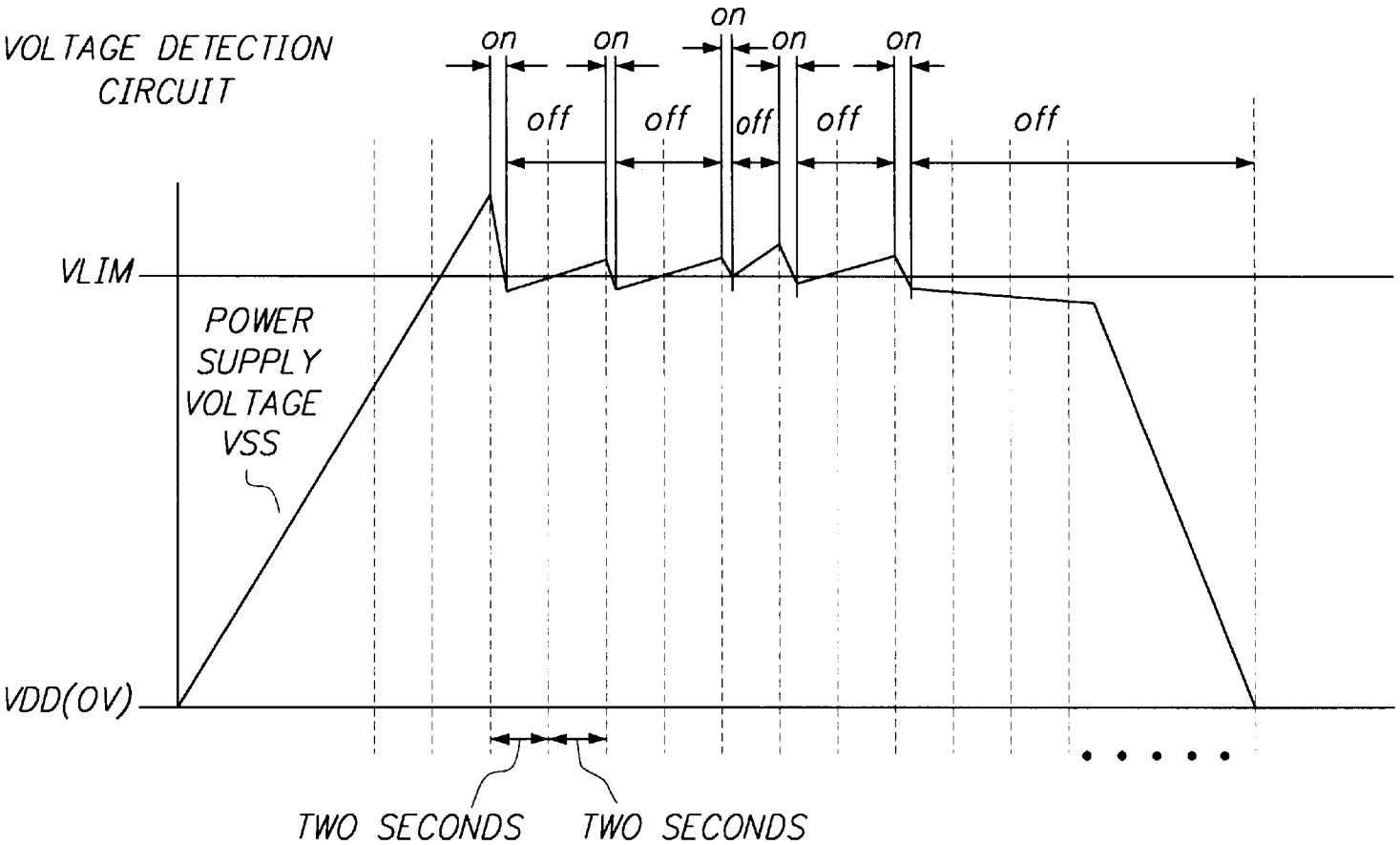
FIG. 6 is a diagram illustrating a change of the power supply voltage over time in the above described second embodiment.

When the detected voltage VSSV' of the comparator 35 is reduced to the set value Vref or lower so as to change the output of the comparator 35 from a low level to a high level, the output of the latch circuit 36 is also changed to a high level almost without a time lag, as shown in FIG. 5, since the latch signal is input at very short intervals. Accordingly, until the sampling clock is input, the output of the AND circuit 37 is maintained as a high level signal so as to turn off the bypass circuit switch 33, thereby stopping the comparator 35, i.e., the voltage detection circuit 32.

In driving the voltage detection circuit 32 by the sampling clock, when the detected voltage VSSV' is equal to or smaller than the set value Vref, i.e., when the voltage of the capacitor 22 is not greater than the limit voltage, the output of the comparator 35 is a high level, and the output of the latch circuit 36 is also maintained as a high level signal. The bypass circuit switch 33 is thus changed to the off state so as to disconnect the bypass circuit 31. Therefore, the electrical energy output from the generator 20 flows into the capacitor 22 and is charged rather than flowing into the bypass circuit 31.

As discussed above, in this embodiment, too, by controlling the input current into the capacitor 22, the voltage VSSV (power supply voltage) of the capacitor 22 is controlled so as not to exceed a predetermined limit voltage VLIM.

According to this embodiment, operational advantages similar to those of the first embodiment can be exhibited, and the following advantages are also offered.

(17) While the voltage of the capacitor 22 exceeds a set value, the voltage detection circuit 32 is constantly driven.

Thus, when the voltage of the capacitor 22 is reduced from a high state to a set value or lower, the bypass circuit switch 33 is instantaneously disconnected so as to interrupt the current from flowing into the bypass circuit 31. As a consequence, in comparison with the first embodiment in which the voltage is detected at regular intervals even while the voltage of the capacitor 22 exceeds the set value, an excessive voltage drop due to a delay in disconnecting the bypass circuit switch 33 when the voltage is reduced can be prevented, and the voltage of the capacitor 22 can be maintained near the set voltage.

Moreover, when the voltage of the capacitor 22 exceeds the set value, the voltage detection circuit 32 is constantly driven. Thus, the consumption current flowing in the bypass circuit 31 can be increased, and for this reason, too, the overcharging of the capacitor 22 can be effectively inhibited.

(18) Further, since the bypass circuit switch 33 can be instantaneously disconnected when the voltage drops, it is not necessary to increase the resistance of the bypass circuit 31 in order to suppress the speed of the voltage drop, thereby comparatively reducing the resistance of the bypass circuit 31 to a smaller level. Accordingly, the current-flowing capacity of the bypass circuit 31 can be enhanced, and when the voltage of the capacitor 22 is increased to a very high level, a greater amount of current can flow in the bypass circuit 31, thereby effectively preventing the overcharging of the capacitor 22.

(19) The voltage-dividing resistors 321 and 322 of the voltage detection circuit 32 also serve as a resistor of the bypass circuit 31, and the bypass circuit 31 is integrated into part of the voltage detection circuit 32. Thus, the number of circuit devices can be reduced to a smaller number than those of the first embodiment, thereby simplifying the circuit configuration. Therefore, the circuit scale can be reduced so as to enhance the miniaturization of the circuit and also to reduce the manufacturing cost.

The present invention is not restricted to the foregoing embodiments, and modifications, improvements, etc. to achieve the object of the present invention are encompassed in the invention.

Figure 7:
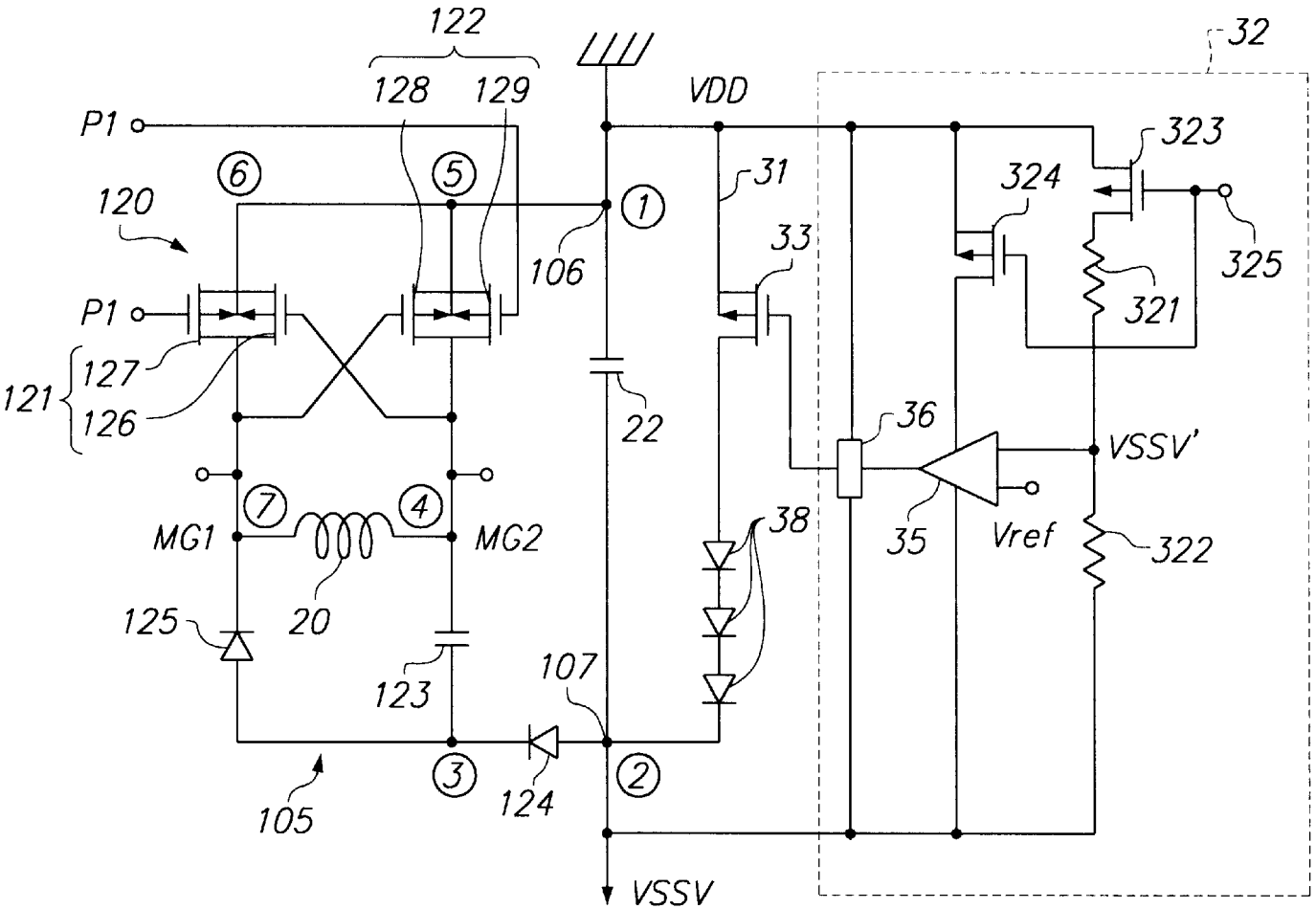
FIG. 7 is a circuit diagram illustrating an example of modifications of the present invention.

More specifically, although in the foregoing embodiments the resistor 34 is provided with the bypass circuit 31, diodes 38 may be provided instead of the resistor 34, as shown in FIG. 7. By the provision of the diodes 38, too, the charging current from the generator 20 can flow into the bypass circuit 31, thereby preventing the overcharging of the capacitor 22. It is also possible to prevent the current from flowing into the bypass circuit 31 from the capacitor 22 immediately after the bypass circuit switch 33 of the bypass circuit 31 is connected, thereby suppressing a sharp reduction in the voltage of the capacitor 22.

The resistance of the resistor 34 of the bypass circuit 31 can be suitably set according to the capacity of the storage device formed by the capacitor 22 or the like. Also, the resistor 34 and the diodes 38 for the bypass circuit 31 may be omitted.

In the above-described first embodiment, the bypass circuit switch 33 of the bypass circuit 31 is intermittently controlled on and off by the drive unit 325, the resistor switch 323, and the comparator switch 324 at regular intervals. This is not essential, and any configuration can be employed as long as it can drive the voltage detection circuit 32 at regular intervals.

Further, the drive unit 325, the resistor switch 323, and the comparator switch 324 of the above-described first embodiment may be omitted, and the bypass circuit switch 33 may be continuously controlled on and off. In this case, the latch circuit 36 for retaining the output of the comparator 35 may be omitted.

Although in the above-described first embodiment the voltage detection circuit 32 is driven by the output of the capacitor 22, another type of power supply, such as a button battery, may be provided to drive the voltage detection circuit 32 by the output of this power supply.

In the rectifier circuit 105 of the aforementioned embodiments, the first DC output terminal 106 is set on the VDD side of the capacitor 22. However, the first DC output terminal may be set on the VSS side ("negative" side) of the capacitor 22, and the first and second switches 121 and 122 may be swapped with the capacitor 123 and the diode 124 and the like so as to be placed on the VSS side (on the side of the first DC output terminal) of the capacitor 22. In this case, the transistors 126 through 129 of the switches 121 and 122 are changed to Nch-type transistors and are inserted between the two AC input terminals MG1 and MG2 of the generator 20 and the VSS side of the capacitor 22, which serves as the first DC output terminal. In this case, the circuit is configured so that the switch 121 or 122 connected to the negative terminal of the generator 20 is maintained in the on state, while the switch 121 or 122 connected to the positive terminal is disconnected.

In the above-described embodiments, two types of chopping signals having different duty ratios and different frequencies are used for performing brake control. However, three or more types of chopping signals having different duty ratios and different frequencies may be used. Alternatively, brake control may be performed without using chopping signals. Moreover, in the foregoing embodiments, a closed loop is formed between the terminals MG1 and MG2 of the generator 20 so as to apply braking by short-circuiting, thereby performing brake control. However, a variable resistor or the like may be connected to the generator 20 so as to change the current flowing in the coil of the generator 20, thereby performing brake control. In short, the specific configuration of the control circuit 56 is not limited to the foregoing embodiments, and may be appropriately set according to the braking method.

The frequency of the chopping signals in the aforementioned embodiments may be suitably set in carrying out the invention. For example, in the above-described embodiments, a frequency on the order of 50 Hz (five times the rotational frequency of the rotor of the generator 20) or higher can improve braking performance while maintaining the charging voltage at a certain value or higher. The duty ratio of each chopping signal may be suitably set in carrying out the invention.

The rotational frequency (reference signal) of the rotor is not restricted to 8 Hz used in the foregoing embodiments, and may be appropriately set in carrying out the invention.

The specific configurations of the rectifier circuit 105, the brake circuit 120, the control circuit 56, the chopping signal generator, etc. are not limited to the above-described embodiments. In particular, as the rectifier circuit 105, a boosting circuit which is able to boost, for example, three times or higher may be built into the rectifier circuit 105, and the configuration may be suitably set according to, for example, the type of electronically controlled mechanical timepiece into which the generator and the rectifier circuit are integrated.

In the second embodiment, the voltage detection circuit 32 is constantly driven when the voltage of the capacitor 22 exceeds a set value. As in the first embodiment, however, the voltage detection circuit 32 may be driven at regular intervals. Conversely, in the first embodiment, the voltage detection circuit 32 may be constantly driven when the voltage of the capacitor 22 exceeds a set value.

As the mechanical energy source for driving the generator 20, not only the mainspring 1*a*, but also rubber, a spring, a weight, or a fluid, such as compressed air, may be employed, and may be suitably set according to the subject to which the present invention is applied. As the means for inputting the mechanical energy into the mechanical energy source, hand-winding, an oscillating weight, positional energy, pressure change, wind power, wave power, water power, temperature difference, etc. may be used.

As the mechanical energy transfer means for transferring the mechanical energy from the mechanical energy source, such as a mainspring, to the generator, not only the wheel train 7 (gear train) used in the foregoing embodiments, but also a friction wheel, a belt (timing belt or the like) and pulley, a chain and sprocket wheel, a rack and pinion, a cam, or the like, may be used. The mechanical energy transfer means may be suitably set according to, for example, the type of electronically controlled timepiece to which the present invention is applied.

As the time indicating device, not only the hands 14, but also a disc-like, a ring-like, or an arc-like device may be used. Alternatively, a digital-display-type time indicating device using a liquid crystal panel or the like may be employed.

Industrial Applicability

As is seen from the foregoing description, according to the present invention, with respect to the generator, the bypass circuit and the storage device are provided in parallel with each other. Thus, when the switch of the bypass circuit is turned on according to the voltage of the storage device, the bypass circuit is conducted so as to allow electrical energy to flow from the generator to the bypass circuit. Accordingly, the current input into the storage device can be decreased so as to reduce the voltage of the storage device, thereby preventing the overcharging of the storage device.

Moreover, the input current into the storage device can be reduced without short-circuiting the generator, thereby preventing a deformation in the generated waveform and a reduction in the voltage level. The generated waveform corresponding to the rotational frequency of the generator can thus be obtained. Accordingly, since the rotation period of the generator can be precisely obtained from the generated waveform, it can be controlled highly precisely and reliably based on this generated waveform, thereby implementing the indication of the correct time.

What is claimed is:

1. An electronically controlled mechanical timepiece including a mechanical energy source, a generator, driven by said mechanical energy source, for outputting electrical energy by generating induction power, a storage device for storing the electrical energy output from said generator, and a rotation control device, driven by electrical energy supplied from said storage device, for controlling a rotation period of said generator, said electronically controlled mechanical timepiece further comprising:

a bypass circuit connected in parallel with said storage device and not in parallel with said generator;

said bypass circuit comprising a bypass circuit switch;

a voltage detection circuit for controlling said bypass circuit switch on and off according to a voltage of said storage device; and wherein said generator includes two terminals and said rotation control device comprises a circuit opening/closing device for disconnecting said terminals of said generator or for connecting said terminals in a closed loop state.

2. An electronically controlled mechanical timepiece set forth in claim 1, wherein said rotation control device comprises a chopping controller for performing chopping control so that an opening/closing period in which said circuit opening/closing device is repeatedly connected and disconnected is shorter than a period of a rotation reference signal, which is a reference for the rotational speed of said generator.

3. An electronically controlled mechanical timepiece set forth in claim 1, wherein said circuit opening/closing device is connected between said generator and said bypass circuit, and between said generator and said storage device.

4. An electronically controlled mechanical timepiece set forth in claim 1, further comprising a rectifier circuit for rectifying a current output from said generator and wherein said rectifier circuit is connected between said generator and said storage device, and between said generator and said bypass circuit.

5. An electronically controlled mechanical timepiece set forth in claim/, wherein a first end of said storage device is connected to a first end of said rectifier circuit connected to said generator, and a second end of said storage device is connected to a second end of said rectifier circuit, and said rectifier circuit and said circuit opening/closing device are connected between said generator and said bypass circuit, and between said generator and said storage device.

6. An electronically controlled mechanical timepiece set forth in claim 5, wherein the first end of said rectifier circuit comprises a first rectifier switch disposed between a first alternating current input terminal of said generator and the first end of said storage device, and a second rectifier switch disposed between a second alternating current input terminal of said generator and the first end of said storage device, and wherein said circuit opening/closing device comprises a first circuit opening/closing switch connected in parallel with said first rectifier switch, and a second circuit opening/closing switch connected in parallel with said second rectifier switch.

7. An electronically controlled mechanical timepiece set forth in claim 1, wherein said voltage detection circuit is driven by an output of said storage device.

8. An electronically controlled mechanical timepiece set forth in claim 1, wherein said voltage detection circuit is driven at regular intervals.

9. An electronically controlled mechanical timepiece set forth in claim 1, wherein said voltage detection circuit is constantly driven when a detected voltage of said storage device exceeds a set value and said voltage detection circuit is driven at regular intervals when the detected voltage is not greater than the set value.

10. An electronically controlled mechanical timepiece set forth in claim 9, wherein said voltage detection circuit comprises a comparator for turning on said bypass circuit switch when the detected voltage of said storage device exceeds the set value and for turning off said bypass circuit switch when the detected voltage is not greater than the set value, and a latch circuit disposed between said comparator and said bypass circuit switch so as to retain an output of said comparator.

11. An electronically controlled mechanical timepiece set forth in claim 10, wherein said latch circuit is operated according to a latch signal, and said latch signal is output at a first time interval when the voltage of said storage device is not greater than the set value, and said latch signal is output at a second time interval, which is shorter than the first time interval, when the voltage of said storage device exceeds the set value.

12. An electronically controlled mechanical timepiece set forth in claim 10, wherein said voltage detection circuit comprises voltage-dividing resistors for dividing the voltage of said storage device and for inputting the divided voltage into said comparator, a resistor switch for interrupting the supply of electrical energy from said storage device to said voltage-dividing resistors, a comparator switch for interrupting the supply of the electrical energy from said storage device to said comparator, and a drive unit for turning on said resistor switch and said comparator switch at regular intervals, and wherein said comparator detects the voltage divided by said voltage-dividing resistors and compares it with the set value.

13. An electronically controlled mechanical timepiece set forth in claim 1, wherein said bypass circuit comprises a resistor having a predetermined resistance.

14. An electronically controlled mechanical timepiece set forth in claims 1, wherein said bypass circuit comprises a diode.

15. An electronically controlled mechanical timepiece set forth in claim 1, wherein said bypass circuit forms part of said voltage detection circuit.

16. An electronically controlled mechanical timepiece set forth in claim 15, wherein said voltage detection circuit comprises voltage-dividing resistors for dividing the voltage of said storage device, and said bypass circuit includes said voltage-dividing resistors.

17. An overcharge-prevention method for an electronically controlled mechanical timepiece which includes a mechanical energy source, a generator, driven by said mechanical energy source, for outputting electrical energy by generating induction power, a storage device for storing the electrical energy output from said generator, and a rotation control device, driven by electrical energy supplied from said storage device, for controlling a rotation period of said generator, said overcharge-prevention method comprising:

connecting a bypass circuit in parallel with said storage device and not in parallel with said generator;

electrically connecting said bypass circuit only when a detected voltage of said storage device exceeds a set value so as to decrease an input current into said storage device; and controlling a rotation period of said generator by disconnecting two terminals of said generator or connecting said terminals in a closed loop state.

18. An overcharge-prevention method for an electronically controlled mechanical timepiece set forth in claim 17, comprising detecting the voltage of said storage device at regular intervals.

19. An overcharge-prevention method for an electronically controlled mechanical timepiece set forth in claim 18, comprising constantly detecting the voltage when the detected voltage of said storage device exceeds the set value, and detecting the voltage at regular intervals when the detected voltage is not greater than the set value.

* * * * *

UNITED STATES PATENT AND TRADEMARK OFFICE

CERTIFICATE OF CORRECTION

PATENT NO. : 6,584,043 B1
DATED : June 24, 2003
INVENTOR(S) : Kunio Koike et al.

It is certified that error appears in the above-identified patent and that said Letters Patent is hereby corrected as shown below:

Title page,
Item [54], please change "ELECTRONICALLY CONTROLLED MECHANICAL WATCH AND METHOD OF PREVENTING OVERCHARGE" to
-- ELECTRONICALLY CONTROLLED MECHANICAL TIMEPIECE AND OVERCHARGE PREVENTION METHOD THEREFOR --.

Column 22,
Line 25, please change "claim/" to -- claim 4 --.

Signed and Sealed this

Twenty-first Day of October, 2003

JAMES E. ROGAN
*Director of the United States Patent and Trademark Office*